US005537709A

United States Patent [19]

Taragos

[11] Patent Number: 5,537,709

[45] Date of Patent: Jul. 23, 1996

[54] BACK SCRUBBER DEVICE

[76] Inventor: Peter Taragos, 216 20th Ave. NE., Minneapolis, Minn. 55418

[21] Appl. No.: 445,131

[22] Filed: May 19, 1995

[51] Int. Cl.[6] ..... A47K 7/02

[52] U.S. Cl. ..... 15/222; 15/210.1

[58] Field of Search ..... 15/222, 160, 210.1, 15/247, 110; 601/135, 138, 137, 143; 401/8, 6

[56] References Cited

U.S. PATENT DOCUMENTS

| | | | |
|---|---|---|---|
| 2,008,990 | 7/1935 | Mullen | 601/143 |
| 2,238,967 | 4/1941 | Brown | 601/143 |
| 2,615,189 | 10/1952 | Novick | 15/160 |
| 2,807,815 | 10/1957 | Mack | 15/222 |
| 3,590,414 | 7/1971 | Gores | 15/167.1 |
| 4,184,221 | 1/1980 | Edwards | 15/210.1 |
| 4,187,575 | 2/1980 | Collins | 401/8 |
| 4,554,699 | 11/1985 | Simmons | 15/160 |
| 4,720,888 | 1/1988 | Menz | 15/222 |
| 5,035,523 | 7/1991 | Allinder | 15/222 |
| 5,175,896 | 1/1993 | Zamir | 15/210.1 |
| 5,386,609 | 2/1995 | Xenos | 15/222 |

FOREIGN PATENT DOCUMENTS

| | | | |
|---|---|---|---|
| 1766539 | 8/1971 | Germany | 601/143 |
| 195999 | 1/1923 | United Kingdom | 15/222 |

*Primary Examiner*—David Scherbel
*Assistant Examiner*—Tony G. Soohoo
*Attorney, Agent, or Firm*—Herman H. Bains

[57] ABSTRACT

A back scrubber device comprises an elongate belt formed of flexible material and having a soap impregnated pad detachably mounted thereon. In the preferred embodiment, the belt is molded to form a plurality recesses for receiving mounting members thereon. The recesses have dove-tailed grooves and the mounting members have beveled edges to define a tongue and groove arrangement. The mounting members have penetrating elements which provide means for mounting the pad on the belt.

3 Claims, 2 Drawing Sheets

BACK SCRUBBER DEVICE

This invention relates to a back scrubber device.

BACKGROUND OF THE INVENTION

There are various commercially available back scrubber devices which facilitate the washing of a person's back. However, most of the commonly used devices are usually brushes having long handles to permit access to all portions of the user's back. In using long-handled brushes or similar devices, soap or detergent has to be applied to the brush or scrubbing component. None of the commercially available back scrubbing devices includes a scrubbing component, such as a brush or sponge, having a source of soap or detergent.

Certain prior art back scrubber devices have been patented but none of them disclose the device defined and claimed herein. For example, U.S. Pat. No. 2,691,787 to Rosenwein discloses a flexible terry cloth belt having a sponge secured to one surface of the belt.

U.S. Pat. No. 4,672,707 to Johnson washing device including flexible body portion comprised of a sponge within a casing. Flexible handles are secured to the body portion.

U.S. Pat. No. 4,512,054 to Clark discloses a back scrubber device formed of terry cloth including a central scrubber section and grasp members secured to the scrubber section.

U.S. Pat. No. 4,720,888 to Menz, U.S. Pat. No. 4,422,205 to Braxter and U.S. Pat. No. 2,363,697 to Schirmer all show scrubbing devices which are generally similar to the above mentioned patents.

SUMMARY OF THE INVENTION

It is an object of this invention to provide a back scrubbing device comprised of a flexible belt having a plurality of mounting members detachably secured to the mid-portion thereof for supporting a soap impregnated scrubbing pad.

In the preferred embodiment, the soap impregnated pad is mounted on the belt by a plurality mounting members which are detachably secured to the belt. The mounting members having penetrating elements which penetrate the pad to secure the pad to the belt. The mounting members may also be used as separate scrubbing devices when removed from the belt.

These and other objects of the invention will be more fully defined in the following Specification.

FIGURES OF THE DRAWING

FIG. 1 is a partially exploded perspective view of the novel back scrubbing device.

FIG. 1*a* is a perspective view of a modified form of the belt.

DESCRIPTION OF THE PREFERRED EMBODIMENT

Figures 1, 1A:
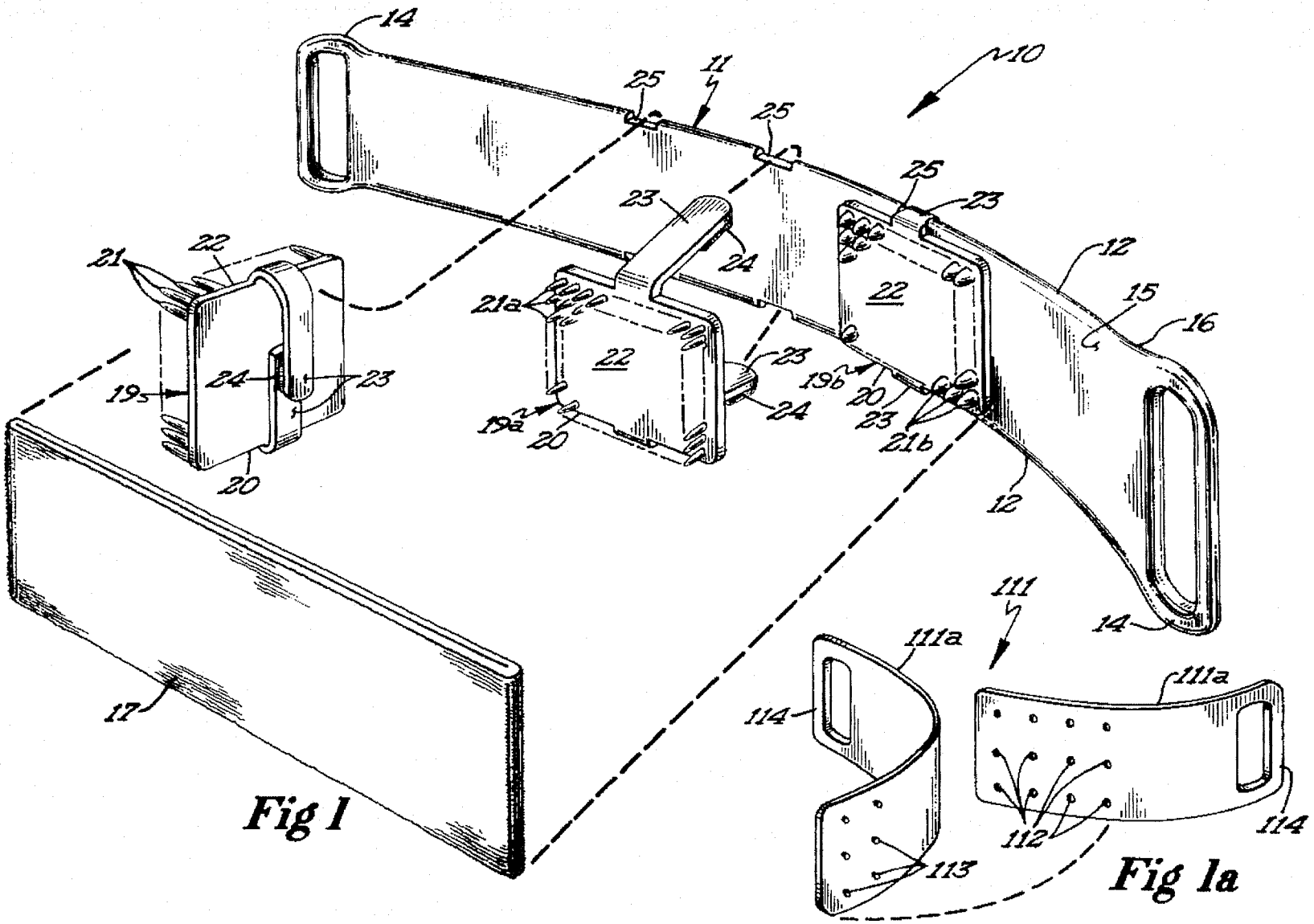

Referring now to the drawings and, more specifically, to FIG. 1, it will be seen that one embodiment of the novel back scrubbing device, designated generally by the reference numeral 10, is thereshown. The back scrubbing device 10 is comprised of an elongate flexible belt 11, which is formed of molded rubber or plastic material. The one piece flexible belt has parallel upper and lower longitudinal edges 12.

Opposite end portions of the flexible belt 11 have molded in openings 13 which form a pair of handles 14. The flexible belt 11 has a substantially flat inner surface 15 and a substantially flat outer surface 16 and is of a length to permit a user to grip the handles 14 as the belt is applied to the surface of the user's back. In the preferred embodiment, the belt may have a length (from handle to handle) within the range of 22 to 30 inches in length and preferably approximately 25 inches.

A generally rectangular-shaped scrubbing pad 17 is secured to the inner surface of the flexible belt adjacent the central portion thereof. The pad 17 may be of single-ply or double-ply construction, preferably formed of terry cloth or the like, and is impregnated with a suitable soap or detergent, which is activated when the pad 17 is wetted or moistened. In the embodiment shown, the soap or detergent may be any of the commercial types.

It will be noted that the length dimension of the scrubber pad 17 is substantially less than the length dimension of the belt 11, but the vertical or width dimension of the pad is only slightly less than the width or vertical dimension of the belt 11. Mounting means are provided for detachably securing the pad 17 to the inner surface 15 of the belt 11.

In this regard, the scrubber pad 17 is attached to the inner surface 15 of the belt 11 by a plurality of mounting members 19, 19*a* and 19*b*. These mounting members each comprise a flat plate 20 and each mounting member penetrating elements 21, 21*a* and 21*b* respectively, projecting from the front surface 22 thereof. These mounting members 19, 19*a* and 19*b* are formed of a plastic or rubber material and are similar to the commercial scrubber devices used by users in scrubbing the user's head. The mounting members are somewhat flexible and are of one piece construction and the plates 20 of the mounting members are of substantially the same size. Each mounting member 19, 19*a* and 19*b* has a pair of attachment straps 23 integrally formed with opposed edges thereof and projecting therefrom. The straps are provided with cooperating Velcro fastening elements 24 to permit attachment of the mounting members to the belt 11. It will be noted that the belt 11 has a plurality of spaced apart upper and lower pairs of notches 25 in the upper and lower longitudinal edges thereof through which the straps 23 project.

The penetrating elements 21, 21*a*, 21*b*, respectively, are different in size and configuration on each of the mounting members 19, 19*a* and 19*b*. In this regard, the penetrating elements on one mounting member may be longer, or more pointed and more flexible than the penetrating elements on another mounting element. However, all of the penetrating elements on one mounting member are of identical size and shape.

In the preferred embodiment shown, the scrubber pad 17 is of double-ply construction. The pad 17 is formed from a single rectangular blank of fabric material, and the blank is folded along fold lines upon itself to define a pair of panels, whose longitudinal edges either abut or are disposed in aligned adjacent relationship.

The soap impregnated pad 17 may be removed by a user for the purpose of removing the mounting members 19 from the belt to permit use of the mounting members for scrubbing different portions of the body. For example, one of the mounting members 19*b* has penetrating elements 21*b* which are short and fairly rigid and can be used to scrub the user's head. The other mounting members 19 and 19*a* may be used to scrub the general body torso or alternatively may be used to scrub a user's feet. This particular arrangement imparts greater utility to the scrubber device for use by a user in bathing.

The area presented by the front panel is substantially the same as the area presented by the outer surface of the pad 17. The double-ply thickness of the scrubber pad 17 permits the impregnation of a greater amount of detergent or soap and may be used several times before the scrubber pad is removed or discarded.

In use, after first wetting the scrubber pad, the user will grip the handles 14 and will apply the scrubber pad to his back while reciprocating the belt in a longitudinal direction. Because of the flexibility of the belt, the pad may be applied to any portion of the back, regardless of the surface contour or location of the area to be scrubbed. After the impregnated soap or detergent has been exhausted, the pad may be replaced by readily removing the spent pad and replacing it with a fresh pad. Removal of the pad involves pulling the pad from impaled relationship on the pointed penetrating mounting members. Spent pads may be re-impregnated, either by the user or may be returned for commercial impregnation.

Figure 3:
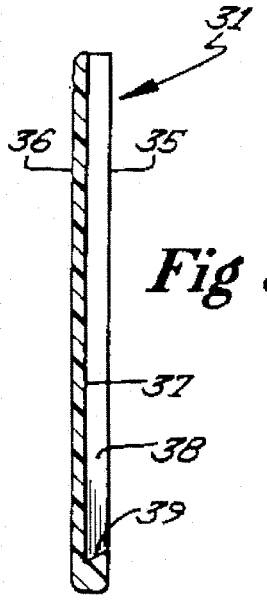
FIG. 3 is a cross-sectional view taken along line 3—3 of FIG. 2 and looking in the direction of the arrows.
Figure 2:
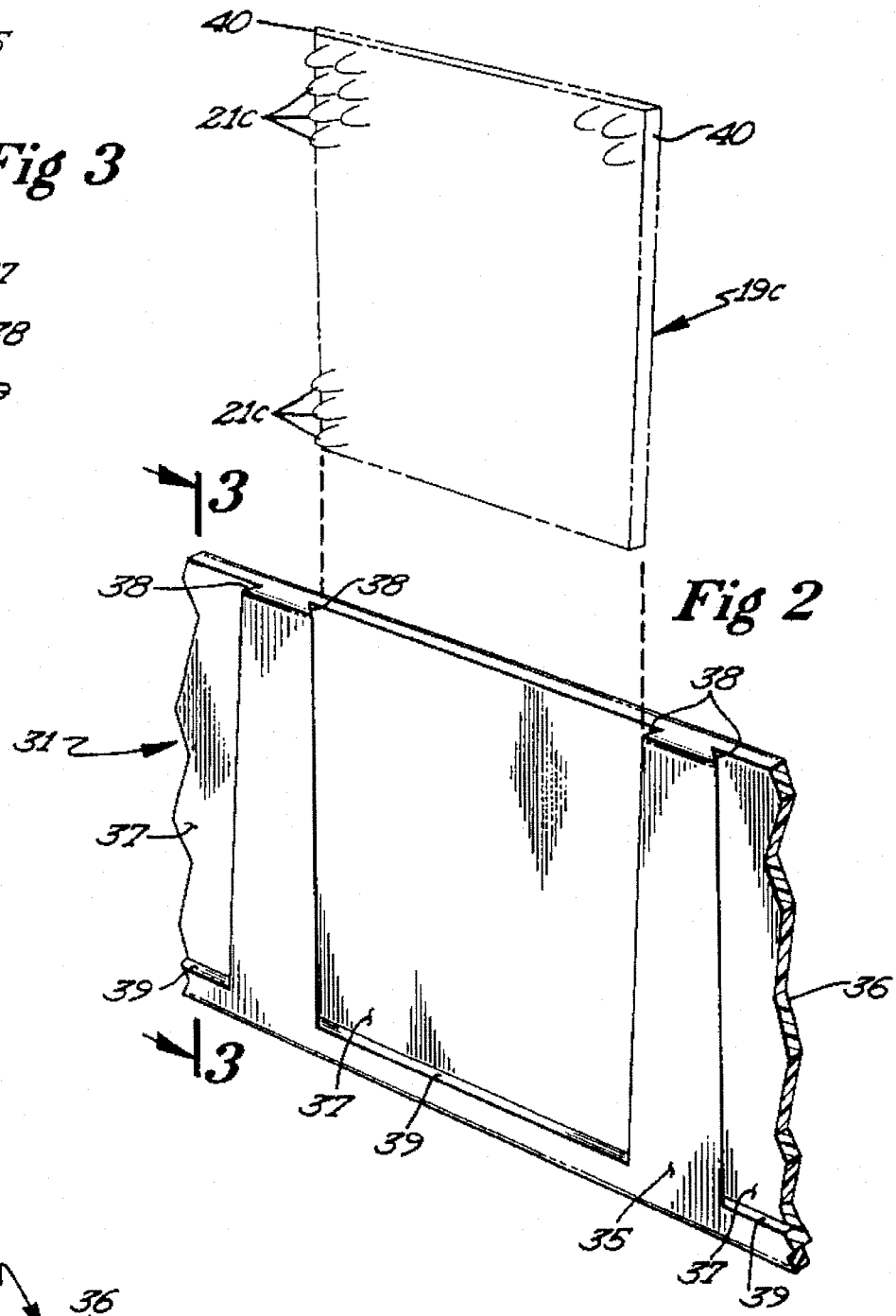
FIG. 2 is a fragmentary exploded perspective view of a different embodiment illustrating a modified manner of attaching the mounting members to the belt.
Figure 4:
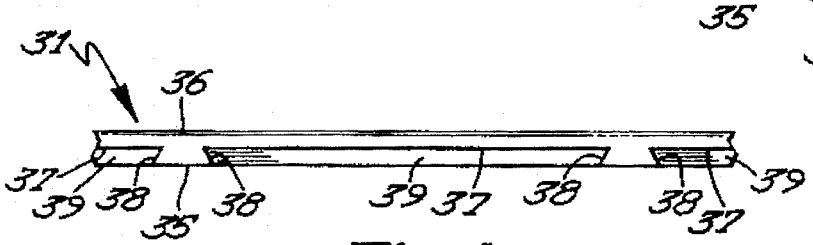
FIG. 4 is a top plan view looking down on the upper edge of the belt.

Referring now to FIGS. 2, 3 and 4, it will be seen that a modified form of the belt and manner of attaching the mounting members on the belt is thereshown. The modified form of the belt is designated generally by the reference numeral 31 and the belt is similar in construction to the belt 11 and has outer end portions with formed handles (not shown) in the manner of the belt 11. The belt 31 also has a flat front or inner surface 35 and a flat rear or outer surface 36. However, the belt 31 is molded to form three generally rectangular shaped recesses 37 in the front surface 35 thereof and disposed in side by side relation. In the embodiment shown, each of the recesses 37 define a pair of vertically disposed dove tailed grooves 38 and a lower horizontal shoulder 39. Each of the recesses is adapted to receive one of the mounting members therein. In the embodiment shown, a mounting member 19*c* is diagrammatically illustrated and will be inserted vertically downwardly into one of the recesses 37. Mounting member 19*c* includes penetrating elements 21*c*, and the penetrating elements each mounting member are different in size and configuration with respect to the penetrating elements on the other mounting members.

Each mounting member has beveled vertical edges 40 which cooperate with the dove tailed grooves 38 of a recess 37 to securely mount the mounting members on the belt. The shoulder 39 for each recess 37 limits downward movement of the associated mounting member so that the mounting members will be positively attached to the belt. The mounting members will serve to attach each scrubber pad 17 to the belt when the scrubber pad is used, or alternatively, the mounting members may be removed from the belt and used separately in the manner of the embodiment of FIG. 1. The tongue and groove arrangement (elements 38 and 40) permits ready attachment and ready removal of the mounting members to and from the belt 31.

Referring now to FIG. 1*a*, it will be seen that a modified form of the belt is thereshown. The belt 111 includes a pair of belt sections 111*a*, each having a handle 114 at one end thereof. One belt section has a plurality of longitudinally spaced apart openings 112 therein. The other section 111*a* has a plurality of studs 113 projecting therefrom. The studs will be inserted into selected openings to permit the length of the belt 111 to be adjusted. Although not shown in FIG. 1*a*, the belt 111 will include the means for attaching the mounting member thereto. It is preferred that this means include the tongue and groove embodiment.

From the foregoing, it will be seen that I have provided a novel back scrubbing device, which is comprised of a flexible belt and a centrally located soap-impregnated pad, which may be readily removed from or applied to, the belt.

Thus, it will be seen that I have provided a novel back scrubbing device which is not only of simple and inexpensive construction, but one which functions in a more efficient manner than any heretofore known comparable scrubber device.

What is claimed is:

1. A back scrubber device comprising an elongate molded flexible belt formed of a moldable yieldable material and having front and rear surfaces, and opposed longitudinal edges, a plurality of dove-tailed grooves on the front surface of said belt, each groove extending from one longitudinal edge toward the opposite longitudinal edge, a plurality of mounting members, each comprising a flat plate having a plurality of penetrating elements extending outwardly from one surface thereof, each mounting member having opposed beveled edges engaging and cooperating with dovetailed grooves on the belt to securely but removably mount the mounting members on the belt, a plurality of soap impregnated fabric scrubber pads formed from a blank of fabric material, the soap in the scrubber pad being activated when moistened, the penetrating elements on each mounting member penetrating and attaching a scrubber pad on the belt whereby the belt and scrubber pads mounted thereon may be used to scrub a user's back, said scrubber pads being removable from said mounting members, and said mounting members being removable from said belt to permit said mounting members to be used as a scrubbing device in a separate manner.

2. The back scrubber device as defined in claim 1 wherein said penetrating elements on each mounting member are of a different size from the penetrating elements on the other mounting members.

3. The back scrubber device as defined in claim 1 wherein said soap impregnated fabric scrubber pad is formed from a blank of fabric material which is folded upon itself to define a two-ply scrubber pad.

* * * * *